United States Patent [19]

Zitelli

[11] 4,333,030

[45] Jun. 1, 1982

[54] IMAGE CONVERTER TUBE WITH CONTRAST ENHANCING FILTER WHICH PARTIALLY ABSORBS INTERNALLY REFLECTED LIGHT

[75] Inventor: Louis T. Zitelli, Palo Alto, Calif.

[73] Assignee: Varian Associates, Inc., Palo Alto, Calif.

[21] Appl. No.: 130,877

[22] Filed: Mar. 17, 1980

[51] Int. Cl.[3] ..... H01J 40/00

[52] U.S. Cl. ..... 313/94; 313/101; 313/478; 316/17

[58] Field of Search ..... 313/94, 101, 102, 474, 313/478; 316/17; 250/213 VT

[56] References Cited

U.S. PATENT DOCUMENTS 2,517,774 8/1950 Epstein ..... 313/478 X
2,567,713 9/1951 Kaplan ..... 313/478
4,177,399 12/1979 Muccigrosso et al. ..... 313/478 X
4,278,736 7/1981 Kamerling ..... 313/478 X

*Primary Examiner*—Davis L. Willis
*Attorney, Agent, or Firm*—Stanley Z. Cole; Richard B. Nelson; Keiichi Nishimura

[57] ABSTRACT

In an image converter tube, the brightness contrast of the output picture is reduced by light which is internally reflected at the surfaces of the window through which the image is viewed. The contrast can be improved by making the window partially light-absorbing, at the expense of a reduction in the overall optical gain. This gain varies considerably from tube to tube. By adding an external filter on the output window, the transmission of the filter can be chosen for each tube to provide the minimum acceptable gain and thus the maximum obtainable contrast.

12 Claims, 5 Drawing Figures

IMAGE CONVERTER TUBE WITH CONTRAST ENHANCING FILTER WHICH PARTIALLY ABSORBS INTERNALLY REFLECTED LIGHT

DESCRIPTION

1. Field of the Invention

The invention pertains to image converter electron tubes such as low-light-level amplifiers and X-ray image intensifiers. In such tubes the output image is produced on an electron-bombarded fluorescent screen and viewed through a transparent vacuum window.

2. Prior Art

As light passes through the output window, some of it is reflected at the outside glass-air interface. The reflected light strikes the inside glass-vacuum surface at different points which may be dark areas of the picture. It may there be re-reflected by the discontinuity in index of refraction or be scattered by the phosphor screen. In television picture tubes it is common to improve contrast by making the output window of glass which is partly light-absorbing. The desired direct image goes through the window only once, while reflected light must go through at least three times. The ratio of reflected to direct is thus improved by at least the square of the transmission coefficient of the window. In television tubes the absorbing window also has the advantage of attenuating reflected room light, which must go through at least twice, more than picture light which goes through only once.

This principle has not been generally applied to electron image-converter tubes because they have been stressed to achieve enough over-all optical gain, and particularly because the gain may be quite variable from tube to tube on the same production run. Also, the image-converter tubes traditionally are sold with specifications of contrast ratio between large bright and dark areas. The degradation due to multiple reflections occurs over relatively smaller areas which, however, are of more real importance for the information content of the picture.

SUMMARY OF THE INVENTION

An object of the invention is to provide an image-converter tube with improved contrast.

A further object is to provide a tube with improved contrast and satisfactory gain.

These objects are achieved by making the tube with an essentially transparent output viewing window, measuring the gain, selecting a filter to absorb as much light as desired without reducing the gain below an acceptable minimum, and attaching the filter in optical contact to the outside surface of the output window.

DESCRIPTION OF THE PREFERRED EMBODIMENTS

Figure 1:
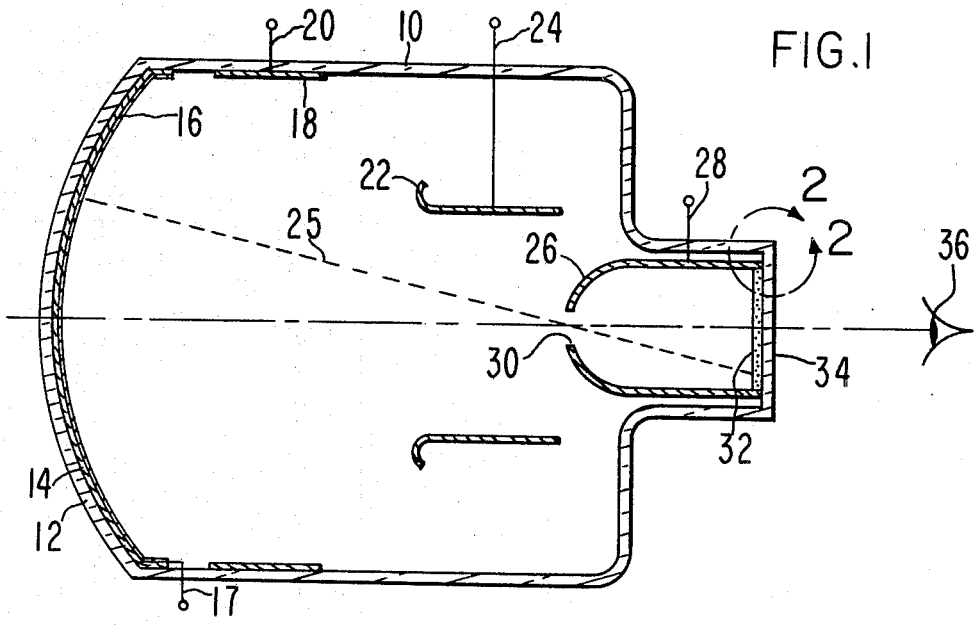
FIG. 1 is a schematic section of an X-ray image intensifier tube.

FIG. 1 shows in schematic form an axial cross-section of an X-ray image intensifier tube. This tube has for example a glass vacuum envelope 10. Metallic envelopes are also used in the art. The convex input "window" 12 is transparent to the rays of the X-ray image incident on it. Deposited on the inside of window 12 is a phosphor layer 14 which, when excited by the X-rays, emits visible light. Deposited on phosphor 14 is a thin photocathode layer 16 which emits electrons when excited by the visible light. A sealed-through lead-in 17 supplies replacement electrons to photocathode 16. Often there is a very thin conducting layer (not shown) between phosphor 14 and photocathode 16 to better supply electrons to all parts of photocathode 16.

The electrons are drawn from photocathode 16 by focusing electrodes 18, 22 which are supplied increasingly positive potentials via lead-throughs 20, 24. The electrons are caused to follow generally straight radial trajectories 25, accelerated toward a hemispherical anode 26 supplied with the most positive potential by a lead-through 28. The electrons are focused through a central aperture 30 in anode 26, and then diverge to strike the output fluorescent screen 32. The fluorescent visible light generated in screen 32 is a geometrical image of the pattern of X-rays on input phosphor 14. The visible light passes through a transparent output window 34 of optically flat glass and is viewed by a suitable receiving system 36 which may be an optical magnifier, a camera or television pickup. The image is not generally viewed directly (as shown) because output screen 32 is deliberately much smaller than input screen 14 in order to amplify its brightness.

Figure 2:
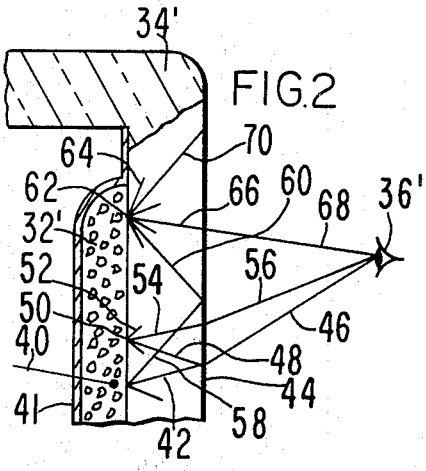
FIG. 2 is a sketch of a section of the output window showing internal light reflections.

FIG. 2 shows on a magnified scale some internal reflections and scatterings which degrade the contrast in the optical image. An electron ray 40 is absorbed in output phosphor screen 32', shown here greatly enlarged in thickness. The visible light produced is emitted in all directions. Phosphor screen 32' is typically covered by a thin, electron-transparent layer 41 as of aluminum which reflects light traveling back toward the photocathode. The paths of two exemplary optical rays 42, 58 are illustrated.

Ray 42 emitted at a large angle to the surface 44 of window 34' is refracted at surface 44, passing to an optical image point 36'. At surface 44 the discontinuity of index of refraction causes a partially reflected ray 48 which returns to phosphor 32' at a point 50 distant from electron ray 40. Here it is scattered, one ray 54 returning and refracted at surface 44 to become viewed ray 56, appearing as extraneous light from a spot which should be dark.

This partially internally reflected light 48 can be reduced by a well-known anti-reflective coating on output surface 44. However, the reduction can not be complete for all incidence angles.

A second ray 58 from the light spot strikes output surface 44 at an angle small enough to cause a total internally reflected ray 60 to return to the inner surface at point 62. Some particles of phosphor screen 32' are in optical contact with the window glass 34' and will scatter part of reflected ray 60 into randomly diverging rays 64. One ray 66 of rays 64 is refracted at glass surface 44 to become ray 68 entering receptor 36'. Part of reflected ray 60 will not be scattered at point 62 but will be again totally internally reflected as ray 70. By successive reflections, however, much of the totally internally reflected light will eventually be scattered and appear as a diffuse background illumination which reduces the contrast. A ring of dark glass surrounding the image area will absorb the remaining reflected light. Anti-reflection coatings do not affect total internal reflection.

In the above description particular light rays have been described as examples of the phenomena of contrast reduction. Of course the light emitted and scattered by the phosphor is emitted in all directions. Thus the spurious light appears as a diffused background around the bright spot.

Figure 3:
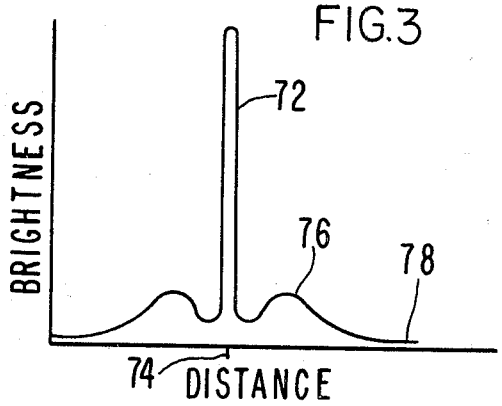
FIG. 3 is a graph of light intensity in the neighborhood of a bright spot.

In FIG. 3 curve 72 is a plot of the screen brightness near a small illuminated spot 74. The brightness falls off rapidly at the edge of spot 74, but with further distance it reaches a secondary broad peak 76 (halo). This is associated with the distance at which the first total internal reflection strikes the screen. For greater distances, it falls steadily to a limiting overall background 78. It is customary in the image tube industry to specify contrast ratio as between a large bright spot and a large dark area well removed therefrom. The effects illustrated by FIG. 3 show that the loss of contrast may be much greater between closely spaced areas, whose resolution is even more important to picture quality. Thus the specified contrast is not a good measure of picture quality.

Figure 4:
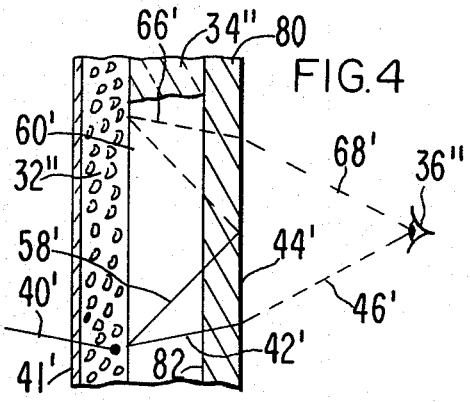
FIG. 4 is a schematic section of a window embodying the invention.

FIG. 4 is a schematic section of an output screen and window embodying the invention. On the outside (air side) of window 34'' is a layer 80 of partially absorbing material such as dark glass. Layer 80 is in optical contact with vacuum window 34'', as by an optical cement joint 82. Direct light ray 42' is not refracted or reflected at joint 82 because the two glasses have approximately equal indices of refraction. Direct ray 42' is diffracted at the outer surface 44' of filter 80 to become the received image ray 46'. Some light will be lost in filter 80. The intensity is indicated by the dashed fraction of ray 46'. Extraneous light 68' from totally internally reflected ray 58' must pass through filter 80 three times before reaching receiver 36''. The ratio of direct image ray 46' to spurious ray 68' is thus improved by $T^2$ where T is the transmissivity of filter layer 80. As mentioned above, such an improvement can be achieved by making the window 34 of partially absorbing glass. A problem with this is that before the image tube is built it is impossible to know exactly the value of the gain, that is the overall quantum amplification from the input X-ray photon to output visible light photons. One thus does not know how much light can be spared for absorption in the window. According to the invention, filter 80 is made as a separate element, attached to transparent window 34'' after the image tube is completed and tested. The tests show how much gain may be spared, so filter 80 is selected for an absorption coefficient which will only reduce the overall gain to a still acceptable level. The manufacturer can thus trade off between gain and contrast to meet customer requirements.

Figure 5:
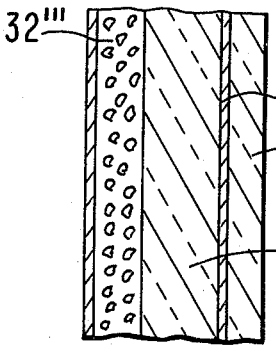
FIG. 5 is a schematic section of a different embodiment of the invention.

FIG. 5 is a schematic section of another embodiment. Instead of an absorptive glass plate 80, a grey filter layer 84 of organic polymer is the absorptive element. Such filters, e.g., the Wratten ® series, are available in a very wide range of transmittances and are quite cheap. For mechanical protection, organic filter 84 may be covered by a transparent glass face-plate 86. Window 34''', filter 84 and faceplate 86 are all in optical contact, as by optical cement, to prevent internal reflections. An advantage of organic filters 84 is that the whole series of transmittances may be of the same thickness, so the position of the optical image is the same for all tubes. The glass filters of FIG. 4 may be made of constant thickness also, but that would require stocks of many different kinds of glass, which would be relatively expensive.

It will be apparent to those skilled in the art that many different variations of the invention may be made. The examples described are intended to be illustrative and not limiting. The invention is to be limited only by the following claims and their legal equivalents:

I claim:

1. An image converter tube comprising an output phosphor screen for generating fluorescent visible light, a substantially transparent vacuum window for viewing said output screen, and filter means having substantially lower optical transmission than said window regarding said fluorescent visible light, said filter means being in optical contact with the surface of said window facing away from said screen.

2. The tube of claim 1 wherein said filter means is a layer of partially absorbing glass.

3. The tube of claim 1 wherein said filter means is a layer of partially absorbing organic plastic.

4. The tube of claim 3 wherein said layer of plastic is covered with a layer of substantially transparent glass.

5. The tube of claim 1 wherein said phosphor screen is deposited on the vacuum side of said window.

6. The tube of claim 1 wherein said transmission is selected to be compatible with the quantum gain of said tube.

7. A method of manufacturing an image converter tube comprising an output phosphor screen, a substantially transparent vacuum window for viewing said screen and an output filter element, said method comprising the steps in order of:

assembling said tube without said output filter element, evacuating and processing said tube without said output filter element, measuring the gain of said tube without said filter element, selecting a filter having optical transmission sufficient that the gain of said tube including said filter is above that required, and affixing said filter in optical contact with said window.

8. The method of claim 7 wherein said output phosphor is deposited on the vacuum side of said window.

9. The method of claim 7 wherein said filter has an index of refraction approximately equal to that of said output window.

10. The method of claim 7 wherein said filter is a layer of partially absorbing glass.

11. The method of claim 7 wherein said filter is a layer of partially absorbing organic plastic.

12. The method of claim 7 further comprising a layer of substantially transparent glass covering said organic plastic.

* * * * *